US008573433B2

(12) United States Patent
Kochanowski

(10) Patent No.: US 8,573,433 B2
(45) **Date of Patent: *Nov. 5, 2013**

(54) STACKABLE AND COLLAPSIBLE CONTAINER

(71) Applicant: George E. Kochanowski, Springboro, OH (US)

(72) Inventor: George E. Kochanowski, Springboro, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/675,483

(22) Filed: Nov. 13, 2012

(65) Prior Publication Data

US 2013/0068763 A1 Mar. 21, 2013

Related U.S. Application Data

(63) Continuation of application No. 13/195,923, filed on Aug. 2, 2011, now Pat. No. 8,308,018, which is a continuation of application No. 12/754,190, filed on Apr. 5, 2010, now Pat. No. 8,011,523, which is a continuation of application No. 11/499,604, filed on Aug. 4, 2006, now Pat. No. 7,703,632.

(51) Int. Cl.
*B65D 6/00* (2006.01)

(52) U.S. Cl.
USPC ..... 220/666; 220/1.5; 220/4.28; 220/4.29; 220/6; 220/7; 220/23.2; 220/650; 217/12 R; 217/13; 217/14; 217/46

(58) Field of Classification Search
USPC ..... 220/1.5, 4.28, 4.29, 6, 7, 23.2, 650, 220/666; 217/12 R, 13, 14, 46
See application file for complete search history.

(56) References Cited

U.S. PATENT DOCUMENTS

| | | | |
|---|---|---|---|
| 1,377,382 | A | 5/1921 | Wyman |
| 1,609,259 | A | 11/1926 | Macnider et al. |
| 1,686,222 | A | 10/1928 | Adler |
| 2,232,346 | A | 2/1941 | Sikes |

(Continued)

FOREIGN PATENT DOCUMENTS

| | | |
|---|---|---|
| EP | 0832825 | 4/1998 |
| FR | 2130226 | 11/1972 |
| JP | 2002160793 | 6/2002 |
| JP | 200264993 | 9/2002 |

OTHER PUBLICATIONS

Priyo, Kathy. "Maximising Space." http://log.ae/2008/09/01/maximising-space/. Sep. 1, 2008. Innovation, Issue Sep. 10, 2008. Accessed Sep. 2, 2008 (7 pages).

*Primary Examiner* — Anthony Stashick
*Assistant Examiner* — Elizabeth Volz
(74) *Attorney, Agent, or Firm* — Brooks, Cameron & Huebsch, PLLC

(57) ABSTRACT

Structures, methods, and systems associated with a stackable and collapsible container are provided. One structure includes a stackable and collapsible container having at least four non-collapsible, load bearing vertical support members attached to vertical walls of the container and capable of supporting the weight of other containers. A top surface is included having a number of sections which include a pivotal connection to one another and which are collapsible about the pivotal connection to an interior of the container. A bottom surface is included having a number of sections which include a pivotal connection to one another and which are collapsible about the pivotal connection to an interior of the container. The top and the bottom surfaces of the container can be fixedly positioned in a number of collapsed states.

11 Claims, 12 Drawing Sheets

(56) References Cited

U.S. PATENT DOCUMENTS

| | | | |
|---|---|---|---|
| 2,361,743 | A | 10/1944 | Butler |
| 2,741,391 | A | 4/1956 | Belanger |
| 2,868,407 | A | 1/1959 | Woodcock |
| 3,128,897 | A | 4/1964 | Wilkins |
| 3,398,850 | A | 8/1968 | Kennard |
| 3,403,806 | A | 10/1968 | Pohl |
| 3,410,328 | A | 11/1968 | Sasai |
| 3,480,174 | A | 11/1969 | Sherwood |
| 3,570,698 | A | 3/1971 | Dougherty |
| 3,612,330 | A | 10/1971 | Baer |
| 3,612,338 | A | 10/1971 | Ekman |
| 3,684,122 | A | 8/1972 | Bonomi |
| 3,752,349 | A | 8/1973 | Rana |
| 3,765,556 | A | 10/1973 | Baer |
| 3,907,147 | A | 9/1975 | Goobeck |
| 3,937,363 | A | 2/1976 | Anderson |
| 4,112,635 | A | 9/1978 | Rylander |
| 4,122,638 | A | 10/1978 | O'Brian et al. |
| 4,158,421 | A | 6/1979 | Chi |
| 4,214,669 | A | 7/1980 | McQuiston |
| 4,577,772 | A | 3/1986 | Bigliardi |
| 4,793,507 | A | 12/1988 | Delplanque |
| 5,107,639 | A | 4/1992 | Morin et al. |
| 5,190,179 | A | 3/1993 | Richter et al. |
| 5,257,830 | A | 11/1993 | Pflueger |
| 5,501,353 | A | 3/1996 | Warren |
| 5,878,903 | A | 3/1999 | Ung |
| 5,890,612 | A | 4/1999 | Coppi |
| 6,032,815 | A | 3/2000 | Elstone |
| 6,108,982 | A | 8/2000 | Davison |
| 6,109,469 | A | 8/2000 | Clive-Smith |
| 6,112,929 | A | 9/2000 | Ota |
| 6,164,476 | A | 12/2000 | Rene et al. |
| 6,182,849 | B1 | 2/2001 | Elstone, Sr. |
| 6,299,009 | B1 | 10/2001 | Ryziuk et al. |
| 7,296,704 | B2 | 11/2007 | Ferrini |
| 7,703,632 | B2 | 4/2010 | Kochanowski |
| 2006/0016807 | A1 | 1/2006 | Hsu et al. |
| 2010/0292063 | A1 | 11/2010 | Chawia et al. |

STACKABLE AND COLLAPSIBLE CONTAINER

PRIORITY INFORMATION

This application is a Continuation of U.S. patent application Ser. No. 13/195,923, filed Aug. 2, 2011, issued as U.S. Pat. No. 8,308,018 on Nov. 13, 2012, which is a Continuation of U.S. patent application Ser. No. 12/754,190, filed Apr. 5, 2010, issued as U.S. Pat. No. 8,011,523 on Sep. 6, 2011, which is a Continuation of U.S. patent application Ser. No. 11/499,604, filed Aug. 4, 2006, issued as U.S. Pat. No. 7,703, 632 on Apr. 27, 2010 the specification of which is incorporated by reference herein.

BACKGROUND OF THE INVENTION

Cargo containers are used for the easy transfer of goods from one transportation medium to another. Such as for shipping cargo overseas, to shipping cargo by rail, to shipping cargo by air, then shipping cargo by tractor trailer. The standardization of cargo containers, also known as containerization, has been almost universally adopted. Virtually the entire global freight container market has adopted the International Organization for Standardization (referred to as "ISO") as its standardization body. The standardization of the containers allows for the stacking of multiple containers upon one another, which allows containers to be stacked as many as twenty containers high.

One of the principal shortcomings found in the use of cargo containers is that the cost to transport a container filled with goods is roughly the same as the cost to transport an empty container. This is because a standard cargo container occupies the same volume whether it is full of goods or not. Due to the large number of containers passing through any given transportation hub, certain regulations require the return of empty containers to their shipping origin.

DETAILED DESCRIPTION

The present disclosure includes various methods, apparatus, and systems associated with stackable and collapsible containers. One embodiment includes a stackable and collapsible container including at least four non-collapsible, load bearing vertical support members attached to vertical walls of the container. That is, the support members are capable of supporting the weight of other containers stacked thereupon. A top surface to the container includes a number of sections having a pivotal connection to one another and which are collapsible about the pivotal connection to an interior of the container. A bottom surface to the container includes a number of sections having a pivotal connection to one another and which are collapsible about the pivotal connection to an interior of the container. The top and the bottom surfaces of the container can be fixedly positioned in a number of collapsed states.

In various embodiments a stackable and collapsible container is fixedly positioned in a fully expanded state and a number of collapsed states, at least in part, through the use of support beams. In various embodiments a support beam can be passed through a portion of a channel in an edge rail of the container structures. In these embodiments the support beams provide additional vertical support for the containers stacked above in a next level and may provide a measure of frictional grip to prevent the containers in the number of collapsed states from moving laterally (horizontally), inward or outward. In various embodiments the containers can additionally be fixedly positioned in the number of collapsed states, at least in part, through an engagement between gripping member formations associated with the non-collapsible, load bearing vertical support members. For example, in various embodiments the gripping member formations include standardized ISO blocks used for gripping, moving, and placing cargo containers. These capabilities allow for an increased efficiency when transporting or storing a number of containers. In some exemplary embodiments, the container may conform to ISO standards and be used in the transportation of cargo. However, embodiments are not limited to such use.

Figure 1A:
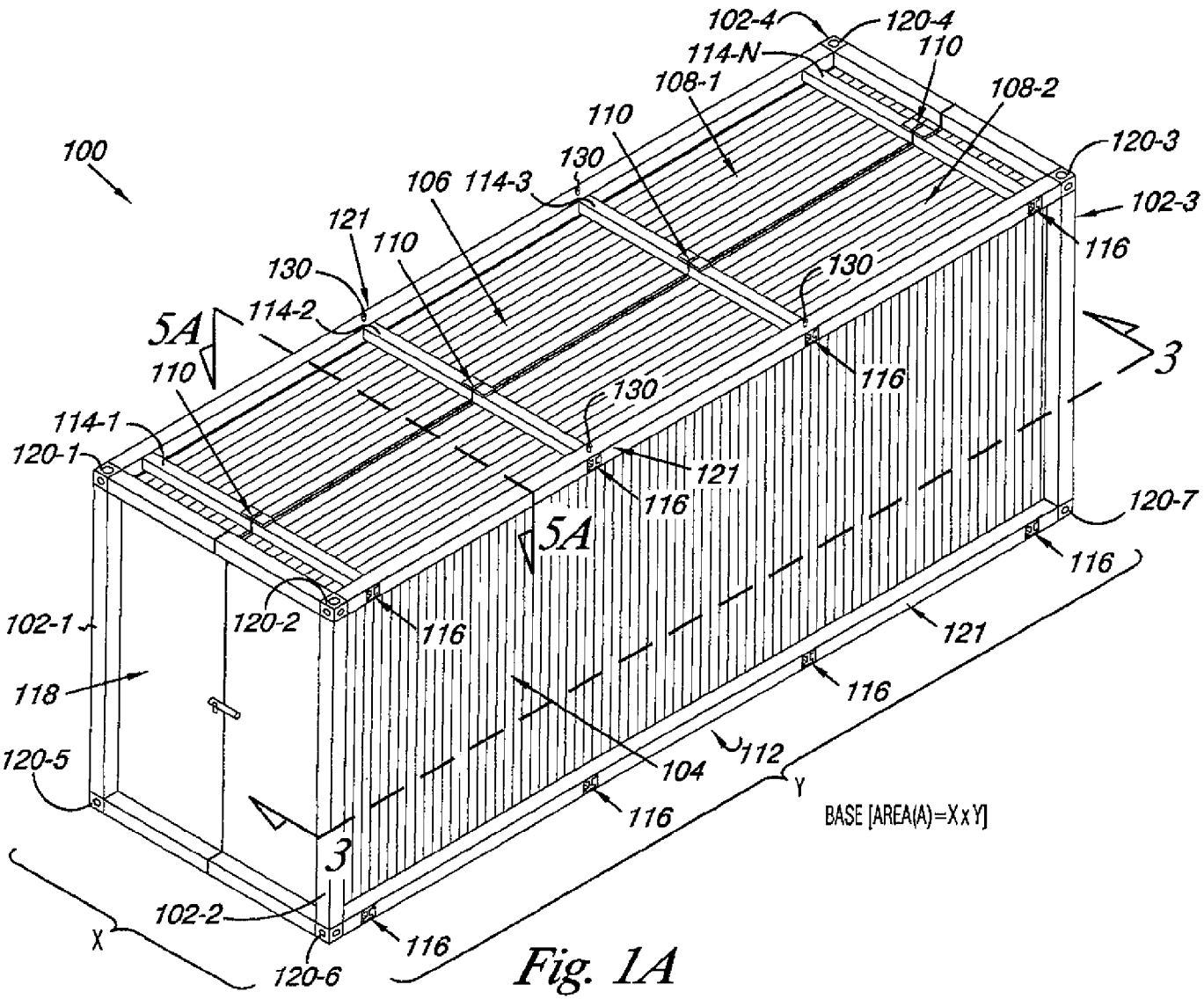
FIG. 1A is a perspective view of an embodiment for a stackable and collapsible container according to the present disclosure.
Figure 6:
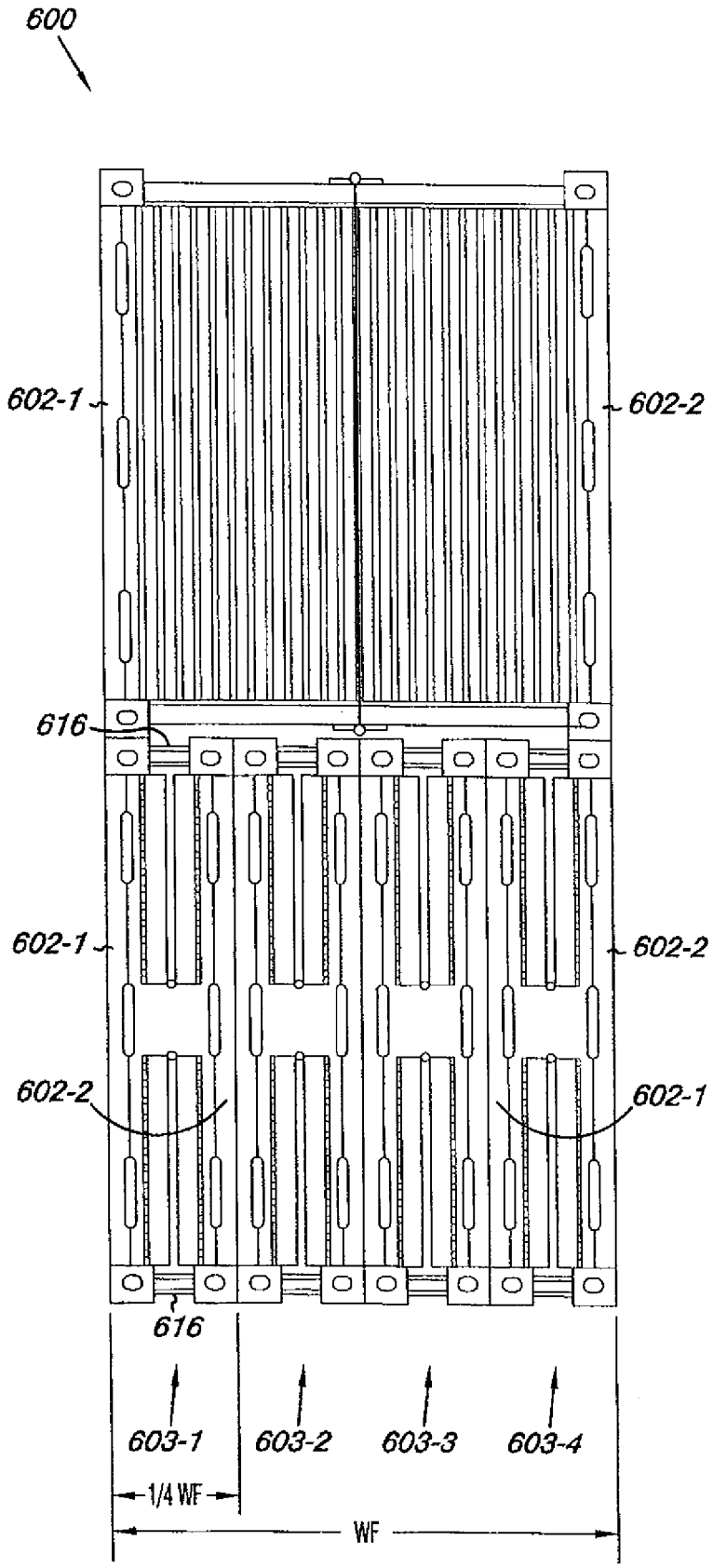
FIG. 6 is an end view of an embodiment of a method for transporting stackable and collapsible containers according to the present disclosure.
Figure 7:
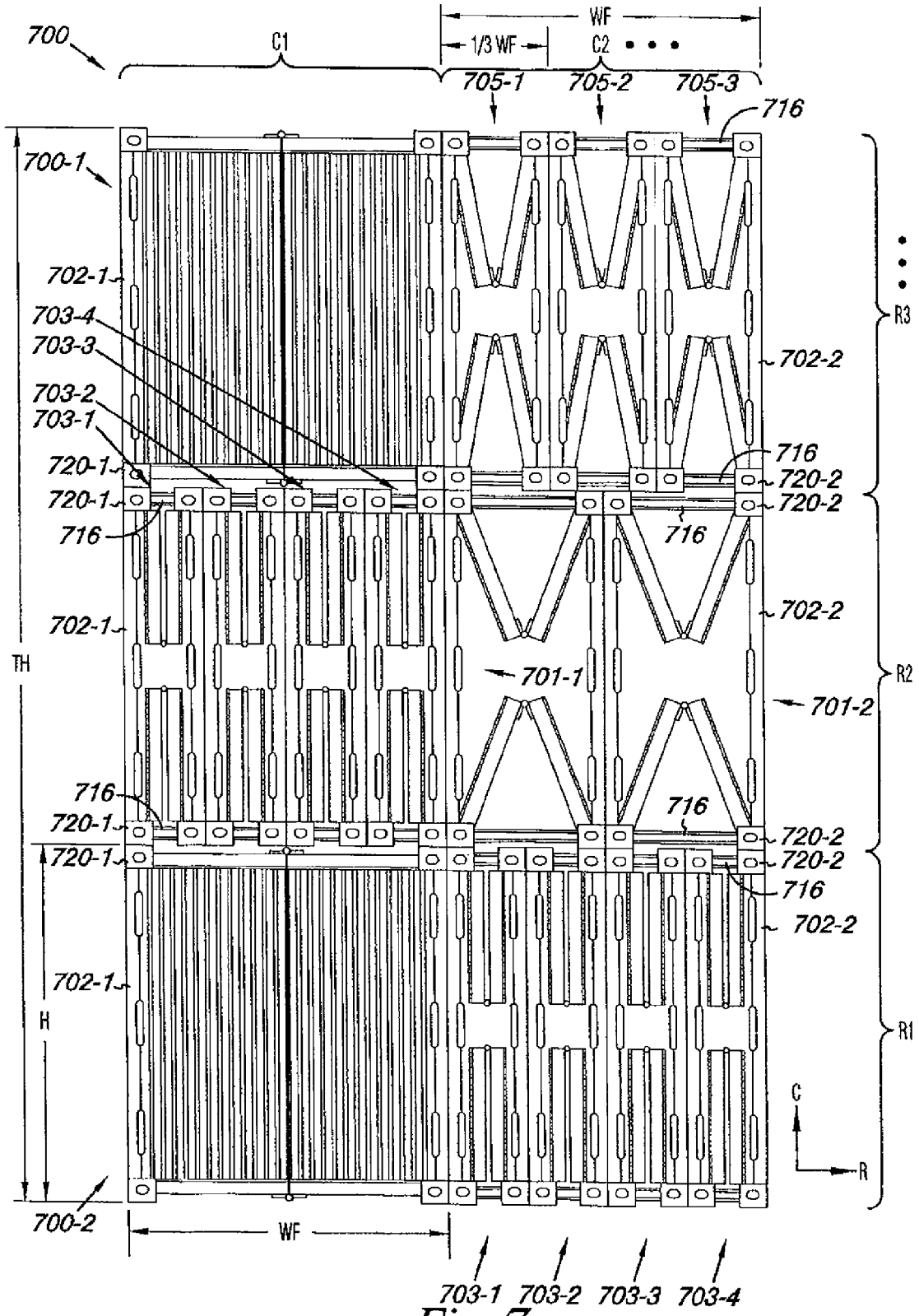
FIG. 7 is an end view of an embodiment of a method for transporting stackable and collapsible containers according to the present disclosure.
Figure 8:
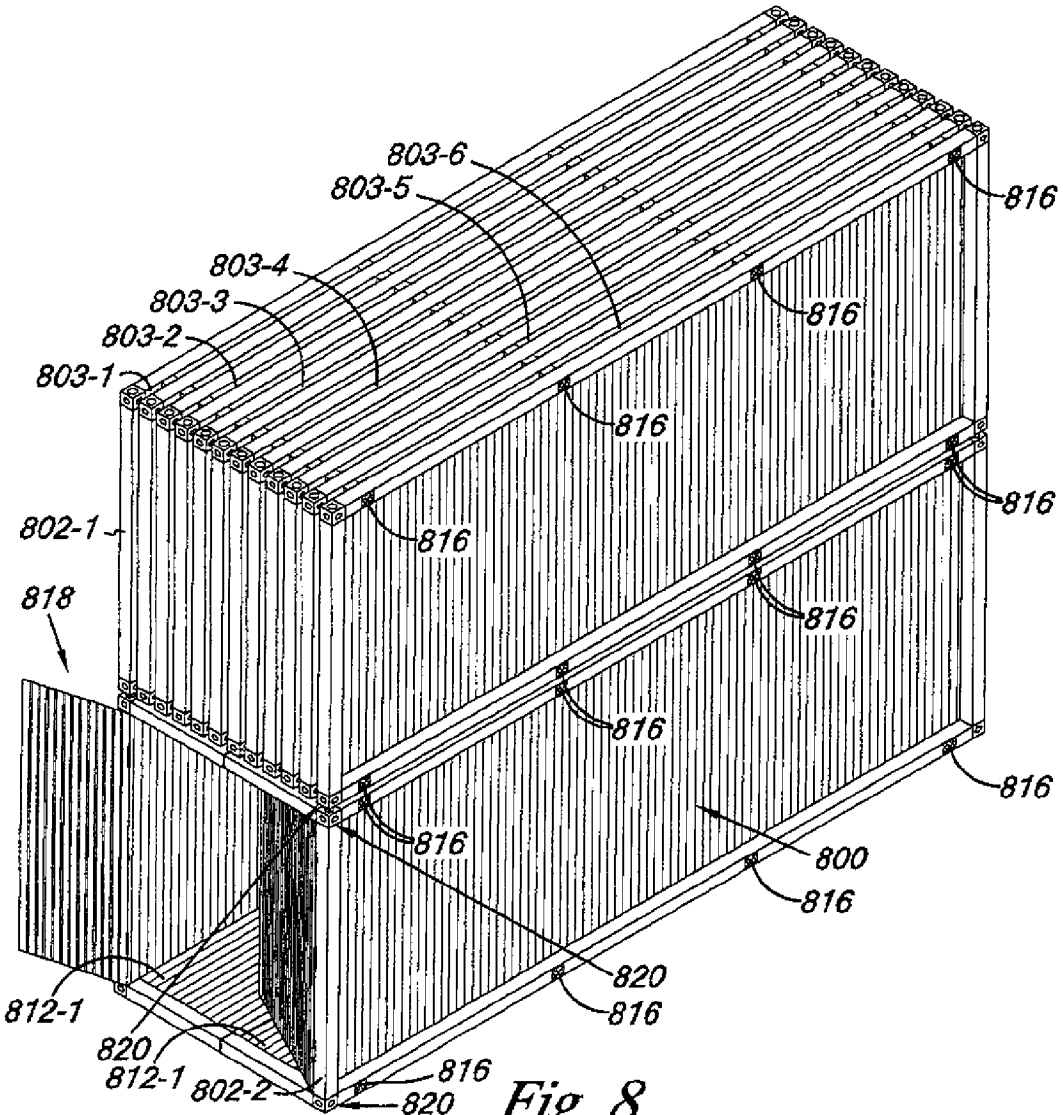
FIG. 8 is a perspective view of an embodiment of a method for transporting stackable and collapsible containers according to the present disclosure.

FIG. 1A is a perspective view of an embodiment for a stackable and collapsible container 100 according to the present disclosure. As shown in the embodiment of FIG. 1A the container 100 includes at least four non-collapsible, load bearing vertical support members, 102-1, 102-2, 102-3, and 102-4 (102-4 behind the perspective view), attached to vertical walls 104 of the container 100. As shown in the embodiment of FIG. 1A, each of the at least four non-collapsible, load bearing vertical support members, e.g., 102-1, 102-2, 102-3, and 102-4, includes a pair of gripping member formations 120-1, 120-2, 120-3, . . . , 120-8 (120-8 not shown in the perspective view), e.g., standardized ISO blocks used for gripping, moving, and placing cargo containers. The at least four non-collapsible, load bearing vertical support members,

102-1, 102-2, 102-3, and 102-4, are capable of supporting the weight of other containers stacked upon them, including fully loaded containers as shown in FIGS. 6-8. Hence, it is intended that the at least four non-collapsible, load bearing vertical support members, 102-1, 102-2, 102-3, and 102-4, are not simply "rigid" but rather additionally constructed to be of a "load bearing" strength suitable to support the weight of other loaded containers placed thereon.

As shown in the embodiment of FIG. 1A the container 100 includes a top surface 106 and a bottom surface 112 (underneath the perspective view), each having a number of sections, e.g. 108-1, 108-2 which include a pivotal connection 110 to one another and which are collapsible about the pivotal connection 110 to an interior of the container 100. As described in more detail in connection with FIGS. 2A-2C, the container 100 can be fixedly positioned in a fully expanded state, e.g. FIG. 2A, and fixedly positioned in a number of collapsed states, e.g. FIG. 2B and FIG. 2C.

In the embodiment of FIG. 1A the top 106 and bottom 112 surfaces of the container 100 each include two sections 108-1 and 108-2, and 108-3 and 108-4 (not shown, underneath the perspective view) respectively, each pair, e.g., 108-1 and 108-2, being connected by a pivotal connection 110. Embodiments, however, are not limited to two sections in a given top 106 and/or bottom 112 surface. For example, in some embodiments the top 106 and/or bottom surfaces can include three or more sections. In the embodiment of FIG. 1A the pivotal connections 110 are shown as hinges. Embodiments, however, are not limited to this example and can include other types of pivotal connections. The pivotal connections 110 can include a seal (described in more detail in connection with FIG. 5C) to insulate the interior of the container 100.

As shown in the embodiment of FIG. 1A the container 100 also includes a number of channels 114-1, 114-2, 114-3 and 114-N associated with at least one of the top 106 and bottom 112 surfaces of the container 100 to receive removable, horizontally positionable support beams 116. In FIG. 1A the container 100 is illustrated having four channels 114-1, 114-2, 114-3 and 114-N which span a full width (W) of the top 106 and bottom 112 surfaces of the container 100. However, embodiments are not limited to a container 100 having four channels and the designator "N" is intended to reflect that various numbers of channels can be implemented according to various embodiments. FIG. 1A illustrates the container 100 in a fully expanded state. In the fully expanded state a support beam 116 can be inserted into the channels 114-1, 114-2, 114-3 and 114-N to fixedly position and/or secure the top 106 and bottom 112 surfaces of the container 100 to prevent the sections, e.g., 108-1 and 108-2, from collapsing inward toward one another about the pivotal connections 110. As shown in the embodiment of FIG. 1A, the number of channels 114-1, 114-2, 114-3 and 114-N illustrated on a top 106 surface of the container 100 are associated with openings in edge rails 121 of the container 100. For example, each vertical wall includes a pair of edge rails 121 associated therewith. As shown in the embodiment of FIG. 1A, the openings in the edge rails 121 may form at least part of the number of channels 114-1, 114-2, 114-3 and 114-N through which support beams 116 can be inserted. Similarly, as shown in FIG. 1A, edge rails 121 to the bottom of the container 100 can have openings through which support beams 116 can be inserted in association with a number of channels (not shown, underneath the perspective view) to the bottom surface 112 of the container 100.

As shown in the embodiment of FIG. 1A, the edge rails can include a number of attachment mechanisms 130, e.g., pins, to attach the support beams 116 in place in association with the number of channels 114-1, 114-2, 114-3 and 114-N. Embodiments, however, are not limited to this example.

Figure 1B:
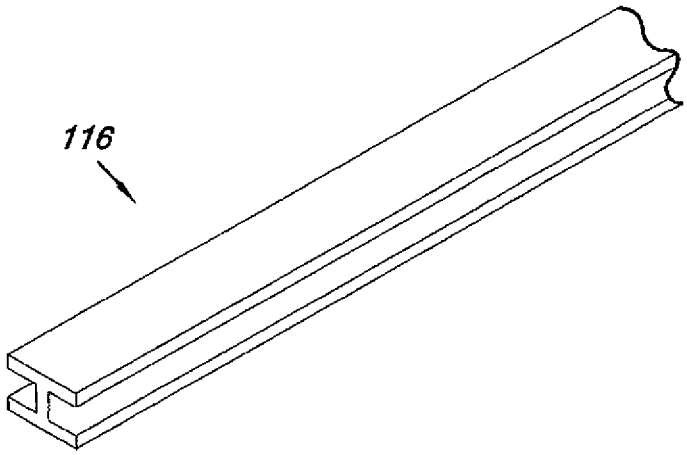
FIGS. 1B-1C illustrate two different embodiments for a support beam locking mechanism for use with various container embodiments.
Figure 1C:
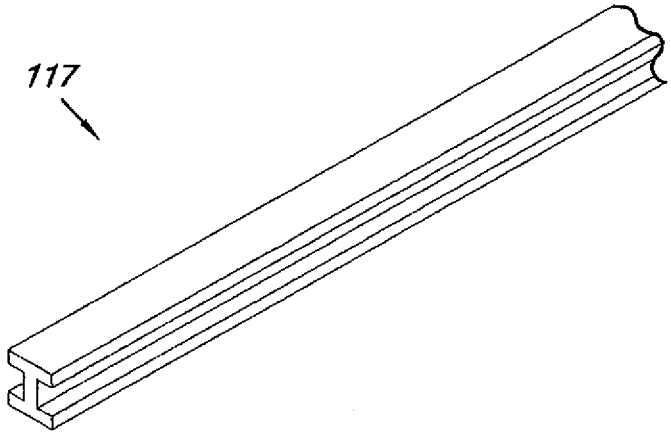

In some embodiments the support beam 116 can include an H-Beam 116, shown in FIG. 1C and illustrated in use in the embodiment of FIG. 1A, placed through the channels 114-1, 114-2, 114-3 and 114-N to prevent the pivotal connection 110 from collapsing inward. In some embodiments the support beam 116 can include an I-beam 117 as illustrated in FIG. 1B placed through the channels 114-1, 114-2, 114-3 and 114-N to prevent the pivotal connection 110 from collapsing inward. When the support beam 116 is an H-beam 116, the channels 114 are square in shape. When the support beam 116 is an I-beam 117, the channels 114 are rectangular in shape. According to various embodiments, the support beams, 116 and/or 117, can be a light weight composite beam material, including corrugated composite materials, suitable to withstand the dimensional, structural, and load bearing demands (e.g., the weight) of containers stacked thereupon as described herein.

According to various embodiments, the support beams, 116 and/or 117, can include one or more discontinuous sections that are capable of engaging one another, e.g., based upon a user action performed at an edge rail 121, to locate the discontinuous sections of the support beams 116 at particular locations at particular times. For example, depending on a desired expanded or collapsed state of the container 100, one or more discontinuous sections of the support beams can be moved in association with the number of channels, 114-1, 114-2, 114-3 and 114-N, and the openings to the edge rails into a location beneath the pivotal connections 110 in an expanded state and away from the pivotal connections 110 in one or more collapsible states.

As shown in the embodiment of FIG. 1A, the container 100 can also include one or more doors 118 pivotally connected to one or more of the vertical support members, 102-1, 102-2, 102-3, and 102-4. More description on embodiments of the pivotal connection for the doors 118 to the vertical support members, 102-1, 102-2, 102-3, and 102-4 is provided in connection with FIGS. 3 and 4.

Figure 2C:
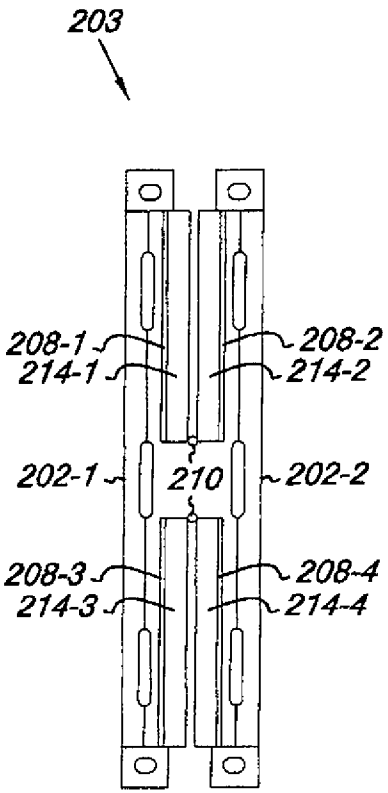
FIG. 2A-2C illustrate end views of an embodiment for a stackable and collapsible container fixedly positioned in a fully expanded state and fixedly positioned in a number of collapsed states according to the present disclosure.
Figure 2B:
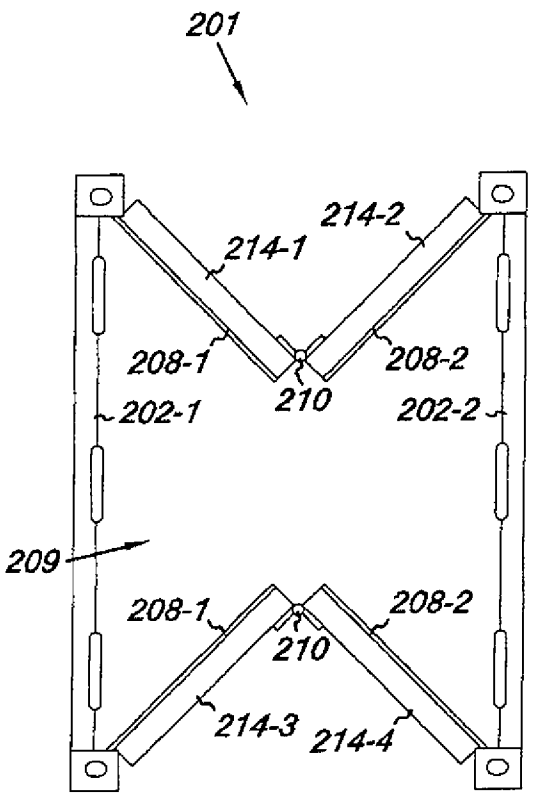
Figure 2A:
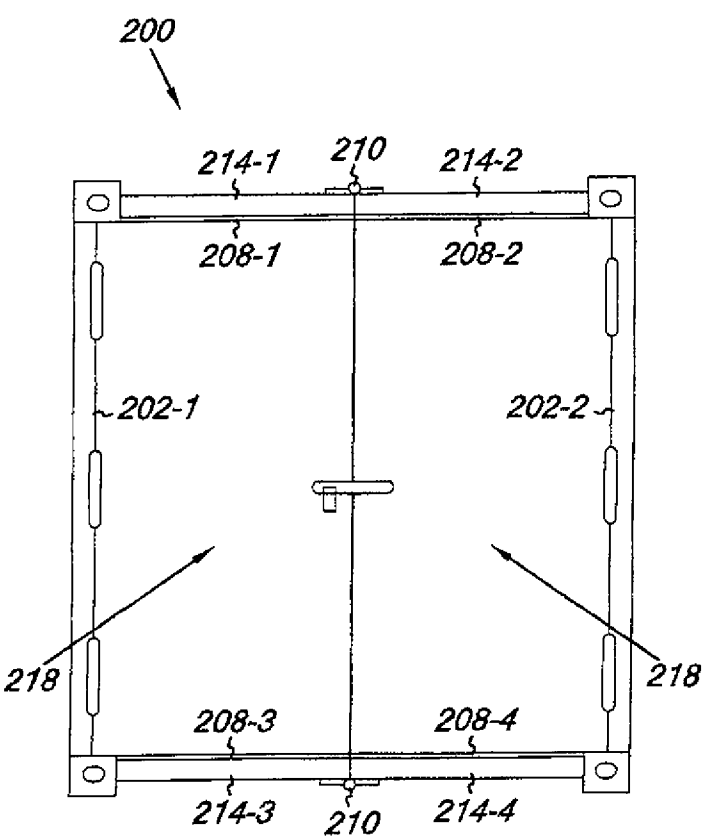

FIG. 2A-2C illustrate end views of an embodiment for a stackable and collapsible container fixedly positioned in a fully expanded state and fixedly positioned in a number of collapsed states according to the present disclosure. FIG. 2A illustrates a container 200, such as shown in FIG. 1, in the expanded state. In the fully expanded state 200 the number of sections, e.g., 208-1, 208-2, 208-3, and 208-4, of the top and bottom surfaces are aligned perpendicular with the non-collapsible, load bearing vertical support members, e.g., 202-1 and 202-2 (viewable in the end views of FIGS. 2A-2C) and the vertical walls 204 associated therewith (not viewable in the end views of FIGS. 2A-2C) of the container 200. FIGS. 2B-2C illustrate a container in a number of fixedly positioned collapsed states. FIG. 2B illustrates a container 201 in a first collapsed state where the number of sections 208 of the top and bottom surfaces are at an acute angle with the vertical walls 204 of the container 201. FIG. 2C illustrates a container in a second collapsed state 203 where the number of sections 208 of the top and the bottom surfaces are aligned parallel with vertical walls 204 of the container. For ease of illustration, FIGS. 2B-2C are shown without a container door present. A more complete illustration of the container door is found in FIG. 3.

FIGS. 2A-2C illustrate the non-collapsible, load bearing vertical support members, e.g., 202-1 and 202-2, which can be attached to vertical walls of the container (not shown) and which are capable of supporting the weight of other containers. In the embodiment of FIGS. 2A-2C a top surface to the container has a number of sections, e.g., sections 208-1 and 208-2, which include a pivotal connection 210 to one another and which are collapsible about the pivotal connection 210 to an interior 209 (shown in FIG. 2B) of the container 200. A bottom surface to the container also includes a number of sections, e.g., 208-3 and 208-4 which include a pivotal connection 210 to one another and which are collapsible about the pivotal connection 210 to an interior 209 of the container 210. As described in more detail later herein, the top and the bottom surfaces of the container can be fixedly positioned in a number of collapsed states.

Figure 3:
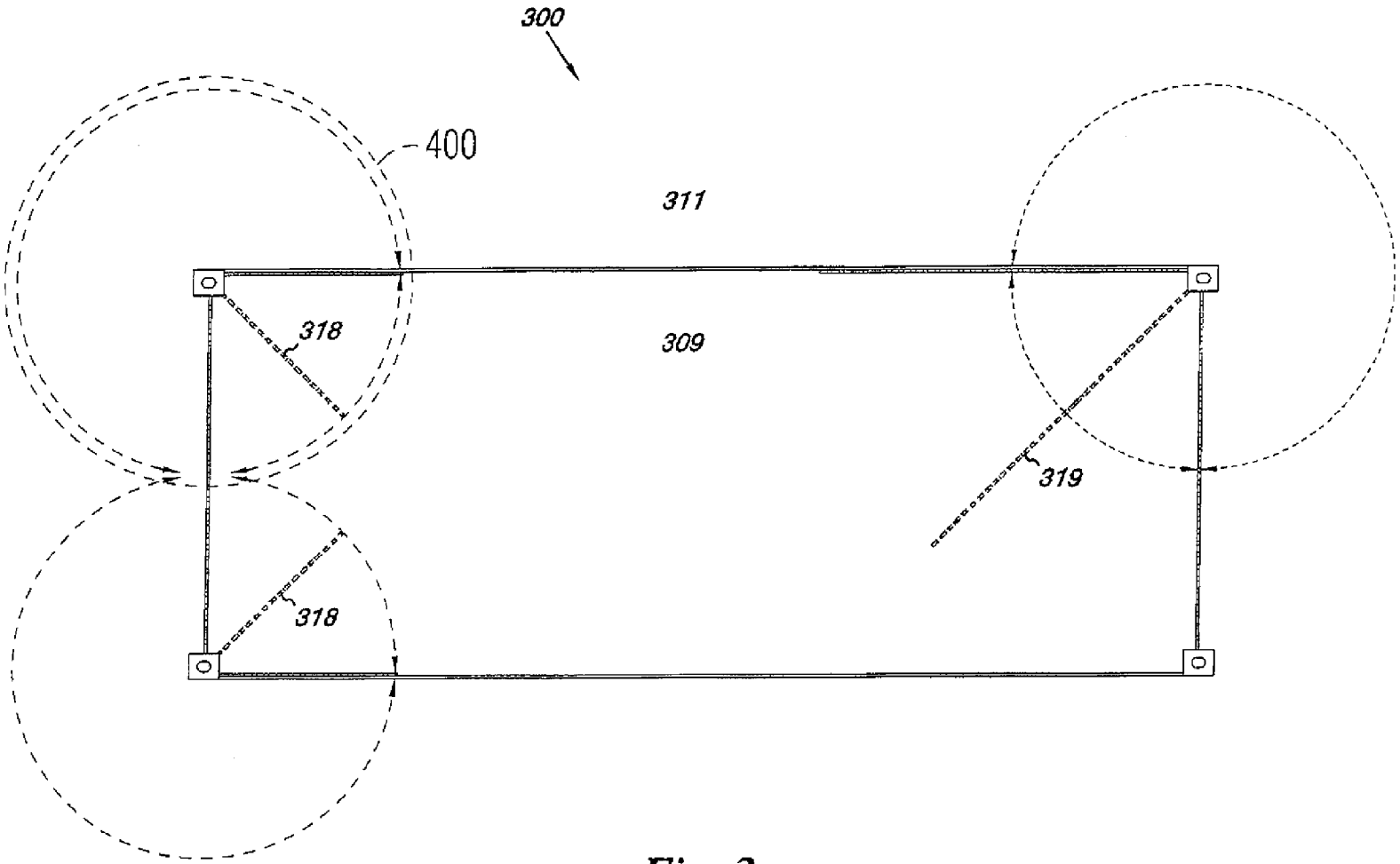
FIG. 3 is a top view along cut line 3-3 from FIG. 1A of an embodiment for a stackable and collapsible container according to the present disclosure.

FIG. 3 is a top view along cut line 3-3 from FIG. 1A of an embodiment for a stackable and collapsible container 300 according to the present disclosure. FIG. 3 illustrates two possible embodiments of a door for the container 300. A first door embodiment 319 spans the entire length of an opening on one end of the container 300. A second door embodiment includes two doors, shown collectively as 318, where each door 318 spans half the length of an opening on the other end of the container 300. As illustrated in the embodiment of FIG. 3, the doors, e.g., 318 and/or 319, can be opened outward to an exterior 311 of the container 300 and inward to an interior 309 of the container 300 including when the container 300 is supporting the weight of other containers, either in an expanded or collapsed state, stacked thereupon.

Figure 4:
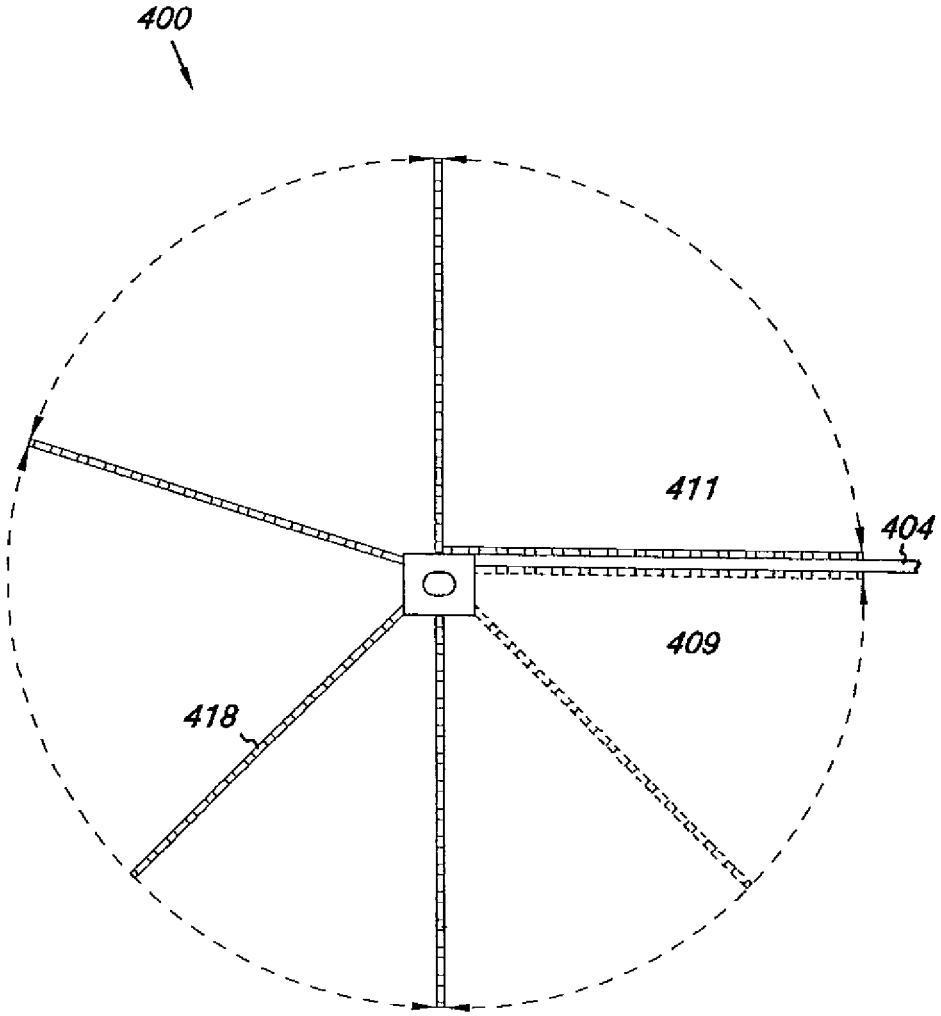
FIG. 4 is an enlarged, cross section top view of a corner, referenced as 400 in FIG. 3, of an embodiment for a door of a stackable and collapsible container according to the present disclosure.

FIG. 4 is an enlarged, cross section top view of a corner, referenced as 400 in FIG. 3, of an embodiment for a door of a stackable and collapsible container according to the present disclosure. FIG. 4 illustrates the capability of the container door 418 to be folded inward, e.g., to rest flush against side wall 404 in an interior 409 of the container 400, and outward, e.g., to rest flush against side wall 404 in an exterior 411 of the container 400. Further, according to embodiments, the doors 318 can be positioned flush against side wall 404 in the interior 409 when the container is one or more of the number of collapsed states described herein. To achieve the same, the door 418 can include a double hinge (not shown), as the same will be appreciated by one of skill in the art, attaching the door 418 to a non-collapsible, load bearing vertical support member, e.g., 402-1. The door 418 is also capable of sealing the container when in an expanded state.

Figure 5A:
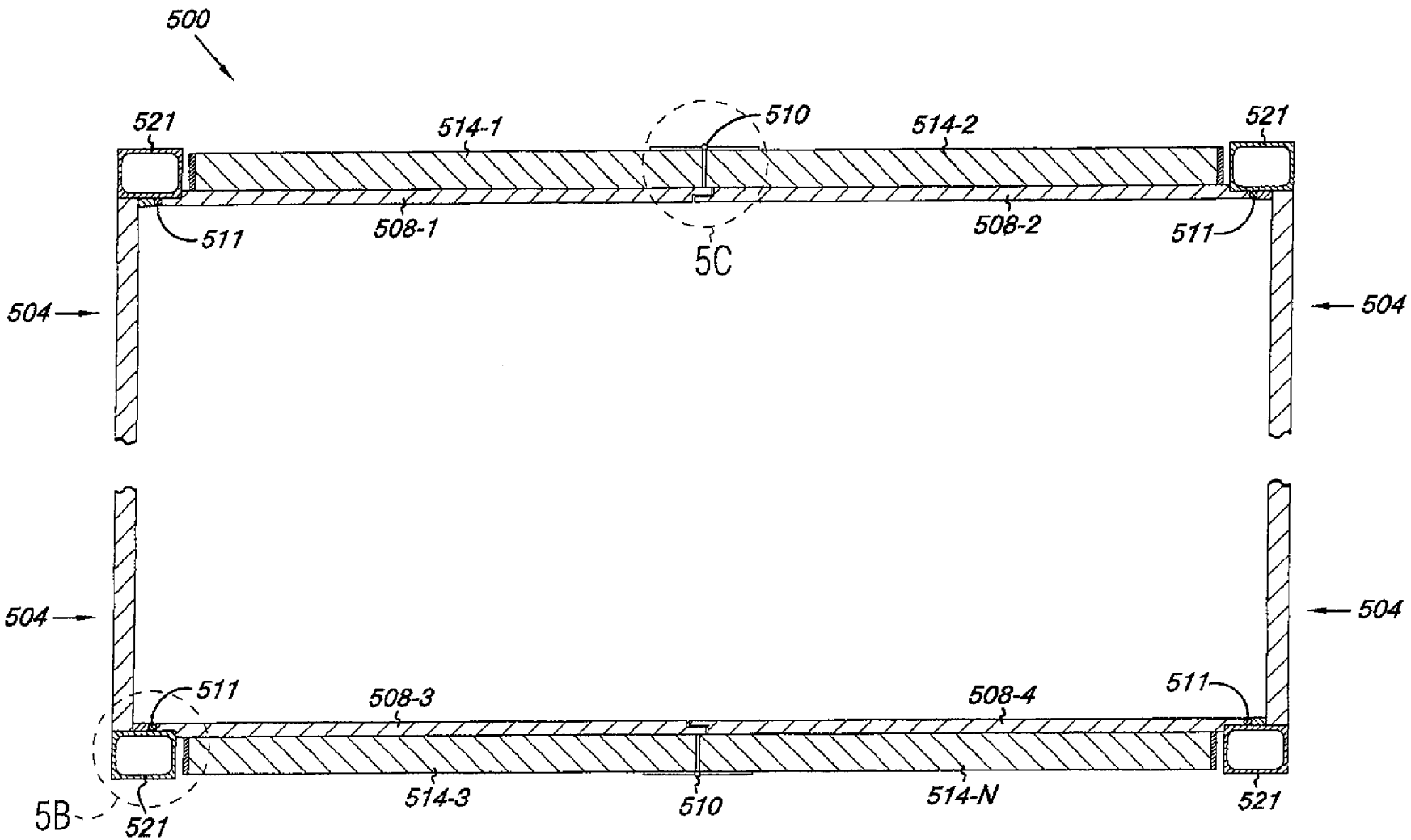
FIG. 5A is an end view along cut line 5A-5A from FIG. 1A of an embodiment for a stackable and collapsible container according to the present disclosure.

FIG. 5A is an end view along cut line 5A-5A from FIG. 1A of an embodiment for a stackable and collapsible container according to the present disclosure. In the present embodiment the top of the container 500 includes two sections 508-1 and 508-2 having associated therewith two channel sections 514-1 and 514-2 which are connected to each other by a pivotal connection 510. In the embodiment of FIG. 5A, the two channel sections 514-1 and 514-2 are connected by one or more first pivotal connections 510. Likewise, in the embodiment of FIG. 5A, the two sections, 508-1 and 508-2, of the top surface of the container 500 are connected to edge rails 521 and to side walls 504 of the container by one or more additional pivotal connections 511. FIG. 5A thus provides another illustration of channels, e.g., 514-1 and 514-2, associated with edge rails 521 into which a support beam, e.g., such as support beams 116 and 117 in the embodiment shown in FIGS. 1B and 1C, can be inserted to restrict some degree of pivotal motion about the pivotal connections 510 and/or 511 when a support beam is placed therein, e.g., when the container is in a fully expanded state 500.

Figure 5B:
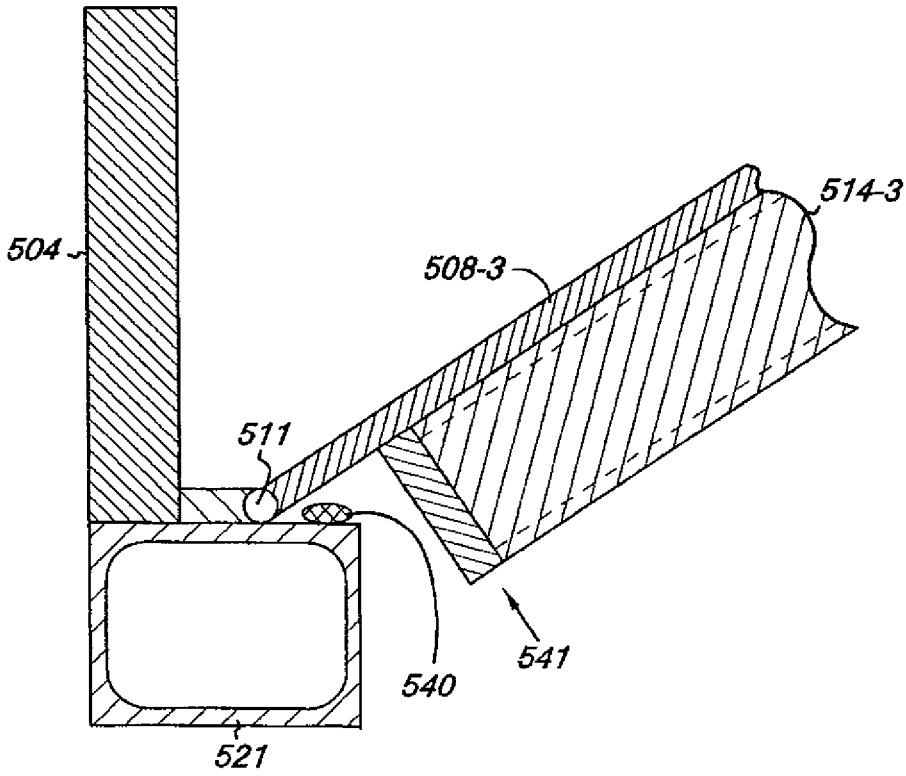
FIG. 5B is an enlarged view of an embodiment of a pivotal connection of the stackable and collapsible container from FIG. 5A according to the present disclosure.

FIG. 5B is an enlarged view of an embodiment of a pivotal connection 511 of the stackable and collapsible container from FIG. 5A according to the present disclosure. FIG. 5B illustrates the pivotal connection 511 of the container in a partially collapsed state instead of the fully expanded state shown in FIG. 5A. FIG. 5B further illustrates the connection between a section, e.g., 508-3, of the bottom surface of the container and a side wall 504 of the container. Also shown is a channel 514-3 attached to the section 508-3 of the bottom of the container. As shown channels, e.g., 514-3, can include one or more seals 541, e.g., elastomer seals around the periphery of their ends. A seal 540 is shown in FIG. 5B which can be positioned between a surface of the edge rail 521 and the section, e.g., 508-3, of the bottom of the container and which may run along an entire length of the edge rail 521 where the edge rail 521 and the section, e.g., 508-3, join. The seal 540 is positioned such that when the container is in the expanded state the seal 540 provides weather proofing between the edge rail 521 and section, e.g., 508-3, as well as for the pivotal connection 511.

Figure 5C:
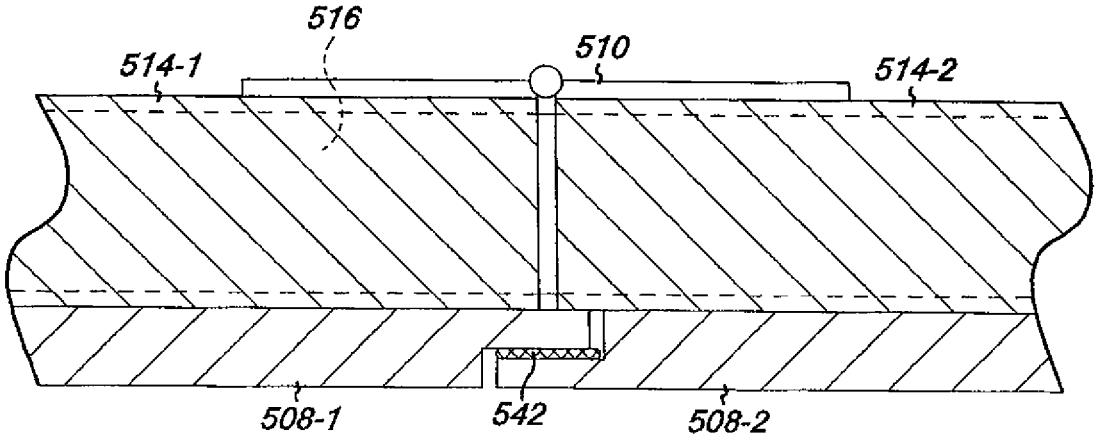
FIG. 5C is an enlarged view of an embodiment for the connection between two sections of a stackable and collapsible container according to the present disclosure.

FIG. 5C is an enlarged view of an embodiment for the connection between two sections of a stackable and collapsible container according to the present disclosure. FIG. 5C illustrates a seal 542 embodiment positioned between two sections, e.g., 508-1 and 508-2, of a top surface of the container. The seal 542 may run along an entire length where the two sections 508-1 and 508-2 join. For example, seal 542 is positioned such that when the container is in the expanded state, e.g., as shown in FIG. 5A, the seal 542 may provide weather proofing between two sections, e.g., 508-1 and 508-2, of a top surface of the container as well as for the pivotal connection 510.

Embodiments, however, are not limited to the above examples and in alternative embodiments the seals 540 and 542 may not run along the entire length where an edge rail 521 and a section, e.g., 508-3, or where two sections 508-1 and 508-2 join. In various embodiments, seals 540 and/or 542 may not be present. In various embodiments more than one, respectively, of seals 540 and 542 may be present, e.g., when a top and bottom surface of the container includes more than two sections. In the embodiment of FIG. 5C, seal 542 is offset from a centerline of the pivotal connection 510.

FIG. 6 is an end view of an embodiment of a method for transporting stackable and collapsible containers according to the present disclosure. FIG. 6 illustrates a container in the fully expanded state 600 stacked upon four containers in the fully collapsed state, e.g., containers 603-1, 603-2, 603-3, and 603-4. Embodiments, however, are not limited to this example. And, as the reader will appreciate, in various embodiments a container in a fully expanded state, e.g., 600, may be stacked upon more or fewer containers in the fully collapsed state. In this example embodiment the width of a container in the fully collapsed state, e.g., 603-1, is equal to twenty five percent (25%) of the width (¼WF) of a container in the fully expanded state, e.g., 600. According to the embodiment of FIG. 6, four containers in the fully collapsed state 603 will fully occupy a base area (A) covered by one container in the fully expanded state, e.g., 600. FIG. 6 also illustrates the capability of the non-collapsible, load bearing vertical support members, e.g., 602-1 and 602-2, when vertically arrayed side by side in the number of collapsed states, as described in connection with FIGS. 2A-2C, to support the weight of another container, e.g., 600, in a fully expanded state stacked above it. As the reader will appreciate, the container in the fully expanded state, e.g., 600, may be loaded with cargo. In other embodiments, a width of a container in the fully collapsed state can be equal to more or less than 25% of the width of a container in the fully expanded state, e.g., 600.

FIG. 7 is an end view of an embodiment of a method for transporting stackable and collapsible containers according to the present disclosure. In the embodiment of FIG. 7 containers are positioned in rows (R) and columns (C) stacked upon one another. For example, in the embodiment of FIG. 7 each row is illustrated having a width at least equal to two times the width (WF) of a container in a fully expanded state, e.g., containers 700-1 and 700-2. In FIG. 7, a column of containers is illustrated having height equal to at least three times a height (H) of a container. Embodiments, however, are not limited to this example. Hence, the embodiment of FIG. 7 illustrates a transportation methodology for allowing containers to be vertically stacked upon one another in columns with such that the vertically stacked containers reach a total height (TH) equivalent to three or more times the height of a container. According to various embodiments described herein, this methodology can be achieved whether the containers are in a fully expanded state, e.g., 700-1 and 700-2 with or without cargo therein, or whether a column includes containers vertically arrayed side by side in the number of collapsed states, e.g., 701, 703, and 705, as described in connection with FIGS. 2A-2C. Since the containers include non-collapsible, load bearing vertical support members, e.g., 702-1 and 702-2, and can be vertically arrayed side by side in the number of collapsed states, the transportation methodology illustrates a first column (C1), three rows high (R1, R2, and R3), which includes a container 700-2 in a first row (R1) in a fully expanded state. Four containers, 703-1, 703-2, 703-3, and 703-4 in a fully collapsed state are vertically arrayed side by side thereupon in second row (R2). Another container, in a fully expanded state 700-1 in a third row (R3) stacked upon the four containers, 703-1, 703-2, 703-3, and 703-4 vertically arrayed side by side in second row (R2).

In the example embodiment of FIG. 7, the second illustrated column (C2) also shows containers stacked three rows high (R1, R2, and R3). The second column (C2) includes four containers, 703-1, 703-2, 703-3, and 703-4 vertically arrayed side by side thereupon in the first row (R1). Two containers, 701-1 and 701-2, are vertically arrayed side by side in the second row (R2) and stacked upon the first row (R1). Three containers, 705-1, 705-2, and 705-3, are vertically arrayed side by side in the third row (R3) and stacked upon the second row (R2).

In the embodiment of FIG. 7, containers, 703-1, 703-2, 703-3, and 703-4, which are in a fully collapsed state and vertically arrayed side by side, individually occupy a base area equivalent to one fourth of a width (¼WF) occupied by a container in the fully expanded state, and vertically arrayed side by side occupy a base area equivalent to a base area, e.g., base area (A) shown in FIG. 1, of a container in the fully expanded state, e.g., containers 700-1 and 700-2. Containers 701-1 and 701-2, which are in a different collapsed state but also vertically arrayed side by side, individually occupy a one half of a width (½WF) occupied by a container in the fully expanded state, and vertically arrayed side by side occupy a base area equivalent to a base area (A) of a container in the fully expanded state, e.g., containers 700-1 and 700-2. Containers 705-1, 705-2, and 705-3, which are in a different collapsed state but also vertically arrayed side by side, individually occupy a base area equivalent to one third of a width (⅓WF) occupied by a container in the fully expanded state, and vertically arrayed side by side occupy a base area equivalent to a base area (A) of a container in the fully expanded state, e.g., containers 700-1 and 700-2. Hence, the embodiment of FIG. 7 illustrates containers in four different states including a fully collapsed state, e.g., 703-1, 703-2, 703-3, and 703-4, a fully expanded state, e.g., 700-1 and 700-2, and at least two partially collapsed states, e.g., 702-1/702-2 and 705-1, 705-2, 705-3.

As the reader will appreciate, the embodiments of the present disclosure may conform to particular size standards, e.g., ISO standards, as to size and other characteristics for the containers in when in a fully expanded state, e.g., 700-1 and 700-2, in order to function with various cargo transport platforms and operational handling standards associated with the movement, placement, and stacking of existing cargo containers. Embodiments, however, are not so limited.

FIG. 7 also illustrates the capability of various embodiments to be fixedly positioned in the fully expanded state, e.g., 700-1 and 700-2, and the number of collapsed states, e.g., 701-1/701-2, 703-1/703-2/703-3/703-4, and 705-1/705-2/705-3. As shown in the embodiment of FIG. 7, the containers are fixedly positioned in the number of collapsed states, at least in part, through the use of support beams 716. In various embodiments a support beam 716 can be passed through a portion of a channel in an edge rail, e.g., shown as 121 in FIG. 1, of the container structures. In these embodiments the support beams provide additional vertical support for the containers stacked above in a next level and may provide a measure of frictional grip to prevent the containers in the number of collapsed states from moving laterally (horizontally), inward or outward. In various embodiments the containers can additionally be fixedly positioned in the number of collapsed states, at least in part, through an engagement between gripping member formations, e.g., 720-1 and 720-2, associated with the non-collapsible, load bearing vertical support members, e.g., 702-1 and 702-2. For example, in various embodiments the gripping member formations include standardized ISO blocks used for gripping, moving, and placing cargo containers.

FIG. 8 is a perspective view of an embodiment of a method for transporting stackable and collapsible containers according to the present disclosure. The embodiment of FIG. 8 is similar in operation and structure to the embodiments discussed above. That is, the embodiment of FIG. 8 illustrates stackable and collapsible containers stacked upon one another. For example, in the embodiment of FIG. 8 a container in a fully expanded state 800 is uniformly supporting a number of containers vertically arrayed side by side in a particular collapsed state. In the embodiment of FIG. 8, the particular collapsed state is a fully collapsed state. In this example, the fully collapsed state has dimensions such that six containers, 803-1, 803-2, 803-3, 803-4, 803-5, and 803-6, in the fully collapsed state can be vertically arrayed side by side, individually occupying a base area equivalent to one six (⅙) of a width (W) occupied by a container in the fully expanded state, and when vertically arrayed side by side occupy a base area equivalent to a width (W) of a container in the fully expanded state, e.g., container 800.

As shown in the embodiment of FIG. 8, doors 818 of a container in the fully expanded state, e.g., 800, is capable of being opened inward and outward even when there are containers, whether fully expanded, fully collapsed, and/or in a partially collapsed state, stacked above the container. The embodiment of FIG. 8 also illustrates gripping members 820 associated with non-collapsible, load bearing vertical support members, e.g., 802-1 and 802-2, and the use of support beams 816 as the same have been described herein.

Figure 9:
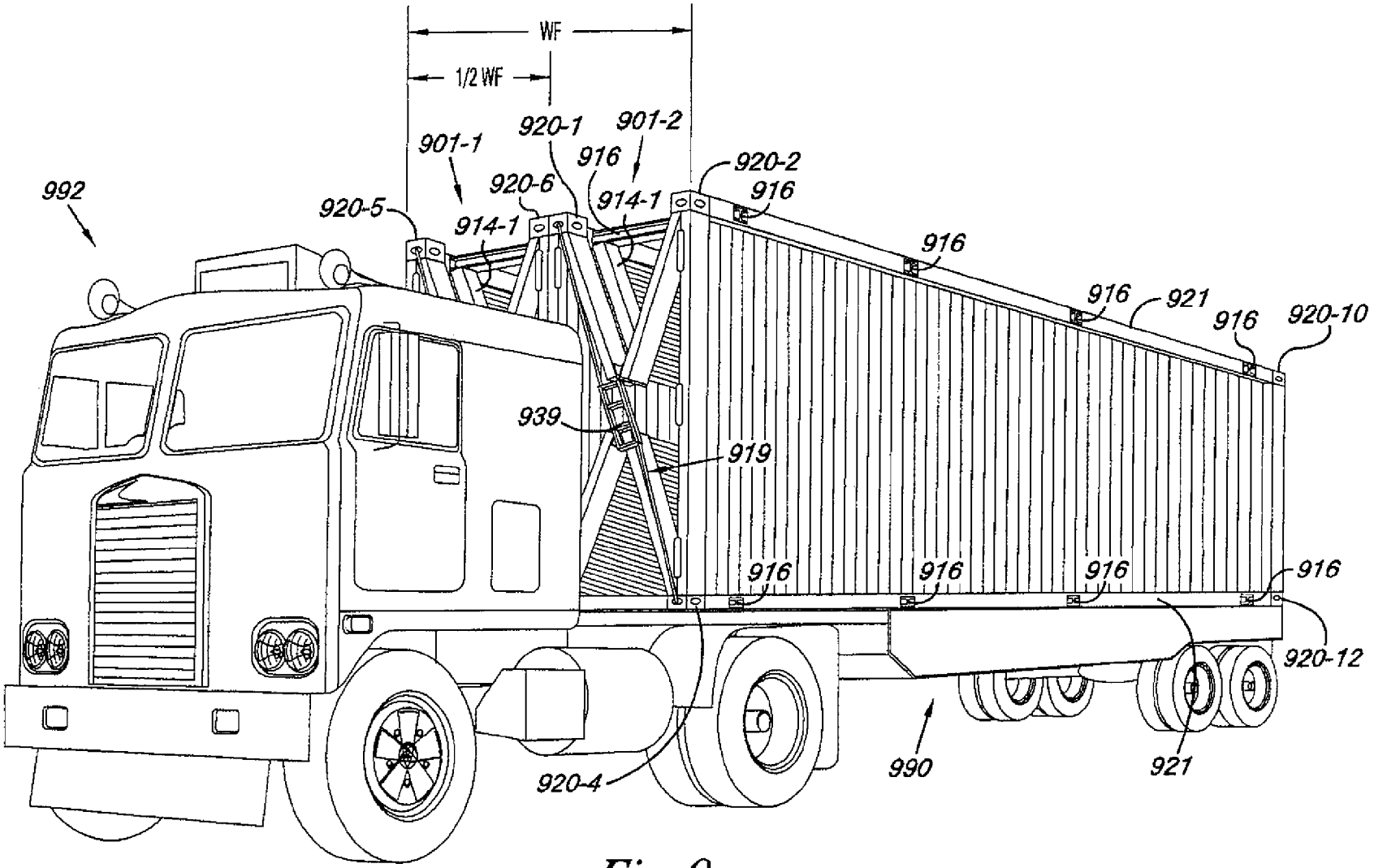
FIG. 9 is a perspective view of an embodiment of a system for transporting stackable and collapsible containers according to the present disclosure.

FIG. 9 is a perspective view of an embodiment of a system for transporting stackable and collapsible containers according to embodiments of the present disclosure. FIG. 9 illustrates a trailer truck transportation system for transporting container embodiments according to the present disclosure. The container transportation system embodiment of FIG. 9 includes one or more stackable and collapsible containers 901 according to various embodiments described herein, e.g., including containers which are horizontally collapsible to a selectable width less than a width of a container in a fully expanded state (WF). As described above, such selectable widths may be secured, or fixedly positioned using a locking mechanism such as a support beam. The container transportation system embodiment of FIG. 9 also includes a container carrier 990 suitable to support the stackable and collapsible container. In various embodiments, edges of the container carrier 990 include a male edge locking mechanism, e.g., a pin, to engage a female component of one or more of the gripping member formations 920, e.g., ISO blocks, associated with one or more containers, e.g., 901-1 and 901-2. For example, the container carrier 990 may include a tractor trailer of the type employed to transport existing cargo containers and having pins upon which ISO blocks of a container seat in an engaged, interlocking manner.

The container transportation system embodiment of FIG. 9 further illustrates an engine, or motive force 992, connected to the platform 990 to power movement of the platform 990. For example, the motive force 992 may include a tractor trailer cab having a diesel engine. As the reader will appreciate, embodiments are not limited to the above described example of a trailer truck transportation system for transporting container embodiments according to the present disclosure. Other container transportation systems such as locomotive railroad transport, ocean shipping freighters, and aircraft may also be used with the embodiments described herein.

The trailer truck transportation system embodiment of FIG. 9 is shown transporting two containers 901-1 and 901-2 in a partially collapsed state. In the example embodiment of FIG. 9 the two containers 901-1 and 901-2 in a partially collapsed state are vertically arrayed side by side, individually having a partially collapsed width equivalent to one half (½WF) of a width of a container in the fully expanded state (WF) and collectively occupying a base area equivalent to a base area (A) occupied by a container in the fully expanded state. That is, according to the embodiments as the same have been described herein, when the two containers 901-1 and 901-2 in the partially collapsed state are vertically arrayed side by side they together occupy a base area equivalent a base area (A) of a container in the fully expanded state, e.g., container 100 in FIG. 1.

The embodiment of FIG. 9 further illustrates an embodiment in which the two containers 901-1 and 901-2 in the partially collapsed state are vertically arrayed side by side and secured by one or more locking mechanisms. For example, as illustrated in the embodiment of FIG. 9, one locking mechanism includes an adjustable beam 919 which can be indexed using an indexing mechanism 939, e.g., a number of rods which can interlock, to fixedly engage at least a pair of the one or more of the gripping member formations 920, e.g., ISO blocks associated with one or more containers 901-1 and 901-2, in a number of positions, e.g., predetermined widths or distances from one another. That is, the indexing mechanism 939 can be used to fix the adjustable beam 919 is a longer width or position to accommodate a lesser number of partially collapsed containers vertically arrayed side by side and can be used to fix the adjustable beam 919 in a shorter width or position to accommodate a greater number of partially collapsed containers vertically arrayed side by side.

In the embodiment of FIG. 9 the adjustable beam 919 is illustrated as diagonally engaging ISO block 920-1 to ISO block 920-4 in a fixed manner using the indexing mechanism 939. Embodiments, however, are not limited to this example. As the reader will appreciate, in various embodiments, the adjustable beam 919 can be configured to diagonally engage ISO blocks 920-5 and 920-4 using the indexing mechanism 939. Likewise, in various embodiments, the adjustable beam 919 can be configured to horizontally engage ISO blocks 920-1 and 920-2, 920-5 and 920-2, 920-6 and 920-4, etc, using the indexing mechanism 939.

In various embodiments, the locking mechanism may be provided by a male edge locking mechanism, e.g., a pin, to the container carrier 990 engaging a female component of one or more of the gripping member formations 920, e.g., ISO blocks, associated with one or more containers, e.g., 901-1 and 901-2. And, as described herein according to various embodiments, the locking mechanism may be provided by slidably passing a support beam 916 through the edge rails 921 of the two containers 901-1 and 901-2 which is then pinned or alternatively fastened in place, e.g., using pins 130 shown in FIG. 1, to fixedly hold the partially collapsed state of the two containers 901-1 and 901-2 when they are vertically arrayed side by side.

The invention claimed is:

1. A stackable and collapsible container, comprising:

at least four non-collapsible, load bearing vertical support members attached to vertical walls of the container, the support members capable of supporting the weight of other containers;

a top surface to the container having a number of sections which include a pivotal connection to one another and which are collapsible about the pivotal connection to an interior of the container;

a bottom surface to the container having a number of sections which include a pivotal connection to one another and which are collapsible about the pivotal connection to the interior of the container; and a door having a pivotal connection on at least one of the non-collapsible, load bearing vertical support members, where the door swings on the pivotal connection from an exterior surface of the container into the interior of the container.

2. The stackable and collapsible container of claim 1, wherein the door having the pivotal connection swings from the interior of the container to the exterior surface of the container.

3. The stackable and collapsible container of claim 1, wherein the pivotal connection includes hinges having a seal to insulate the interior of the container.

4. The stackable and collapsible container of claim 1, wherein the top and the bottom surfaces of the container are fixedly positioned by a horizontal support beam.

5. The stackable and collapsible container of claim 4, wherein each of the top surface and the bottom surface include an edge rail with an opening, where the horizontal support beam passes through at least one of the opening in the edge rail of the top surface and the bottom surface.

6. The stackable and collapsible container of claim 4, wherein the horizontal support beam can position the stackable and collapsible container in:

a first collapsed state, where the number of sections of the top and the bottom surfaces are at an acute angle with the vertical walls of the container; and a second collapsed state, where the number of sections of the top and the bottom surfaces are aligned parallel with vertical walls of the container.

7. The stackable and collapsible container of claim 6, wherein a width (W) of the first collapsed state is equal to fifty percent of the width of an expanded state of the container.

8. The stackable and collapsible container of claim 6, wherein a width of the second collapsed state of the container allows for a number of such containers collapsed to the second state to fully occupy a base area covered by an expanded state of the container.

9. The stackable and collapsible container of claim 1, wherein:

the at least four non-collapsible, load bearing vertical support members each include a gripping member formation which conforms to international standards as to size, configuration, and location so that the container can be picked up and moved by a standard container handling device; and wherein the top and the bottom surfaces of the container are fixedly positioned in a number of collapsed states by a mechanism which utilizes the gripping member formation.

10. The stackable and collapsible container of claim 9, including an adjustable beam that fixedly engages at least a pair of the gripping member formation.

11. The stackable and collapsible container of claim 10, where the adjustable beam includes an indexing mechanism to fix a length of the adjustable beam.

* * * * *